US009903627B2

(12) United States Patent
Fraser et al.

(10) Patent No.: US 9,903,627 B2
(45) Date of Patent: Feb. 27, 2018

(54) METHOD OF OPERATING AN AIR CONDITIONING SYSTEM INCLUDING REDUCING THE ENERGY CONSUMED BY THE COMPRESSOR CRANK CASE HEATERS

(71) Applicant: Carrier Corporation, Farmington, CT (US)

(72) Inventors: Eric B. Fraser, Canastota, NY (US); Algirdas Bielskus, Syracuse, NY (US); Eugene Duane Daddis, Jr., Manlius, CT (US); Lee G. Tetu, Baldwinsville, NY (US)

(73) Assignee: CARRIER CORPORATION, Farmington, CT (US)

( * ) Notice: Subject to any disclaimer, the term of this patent is extended or adjusted under 35 U.S.C. 154(b) by 593 days.

(21) Appl. No.: 14/072,052

(22) Filed: Nov. 5, 2013

(65) Prior Publication Data

US 2014/0124166 A1 May 8, 2014

Related U.S. Application Data

(60) Provisional application No. 61/723,072, filed on Nov. 6, 2012.

(51) Int. Cl.
*F25B 41/00* (2006.01)
*F25B 49/02* (2006.01)

(52) U.S. Cl.
CPC ..... *F25B 49/022* (2013.01); *F25B 2400/01* (2013.01); *F25B 2400/075* (2013.01)

(58) Field of Classification Search
CPC ..... F25B 49/022; F25B 2400/01; F25B 2400/075
USPC ..... 62/196.1
See application file for complete search history.

(56) References Cited

U.S. PATENT DOCUMENTS

| | | | | |
|---|---|---|---|---|
| 3,133,429 A | | 5/1964 | Griffin | |
| 3,312,081 A | * | 4/1967 | Berger | F25B 49/022 318/472 |
| 3,377,816 A | * | 4/1968 | Berger | F25B 49/022 62/157 |
| 3,577,741 A | * | 5/1971 | Shaw | F25B 31/002 62/192 |

(Continued)

FOREIGN PATENT DOCUMENTS

| | | |
|---|---|---|
| JP | 61031684 A | 11/1980 |
| JP | 59128986 A | 7/1984 |

(Continued)

*Primary Examiner* — Ljiljana Ciric
(74) *Attorney, Agent, or Firm* — Cantor Colburn LLP

(57) ABSTRACT

A method of operating an air conditioning system includes cooling a selected space with the air conditioning system. The air conditioning system includes two or more compressors and two or more crank case heaters. Each crank case heater of the two or more crank case heaters is operably connected to a compressor of the two or more compressors. Operation of the two or more compressors is stopped, thus initiating operation of the two or more crank case heaters. The air conditioning system is switched to a conservation mode, including de-powering at least one compressor of the two or more compressors and a connected at least one crank case heater or the two or more crank case heaters.

6 Claims, 2 Drawing Sheets

(56) References Cited

U.S. PATENT DOCUMENTS 3,636,723 A * 1/1972 Kramer ..... F25B 43/006 62/197
3,785,169 A * 1/1974 Gylland, Jr. ..... F04B 39/0207 417/7
4,066,869 A * 1/1978 Apaloo ..... F04B 39/0207 184/104.1
4,226,604 A * 10/1980 Weis ..... F24D 11/0221 62/196.1
4,282,003 A * 8/1981 Yashin ..... H01C 1/024 174/549
4,444,017 A 4/1984 Briccetti et al.
4,506,519 A * 3/1985 Morse ..... F25B 43/00 62/190
4,570,449 A * 2/1986 Knokey ..... F24D 17/02 62/183
5,012,652 A * 5/1991 Dudley ..... F04B 39/00 62/192
5,054,293 A 10/1991 Schwecke
5,230,222 A * 7/1993 Erbs ..... F25B 31/002 62/192
5,252,036 A * 10/1993 Bunch ..... F01M 5/021 417/313
5,572,878 A * 11/1996 Kapoor ..... F04B 39/06 236/1 EA
6,591,621 B2 * 7/2003 Loprete ..... F04B 39/0005 62/160
6,705,107 B2 * 3/2004 Schlosser ..... F25B 5/02 62/344
6,834,513 B2 12/2004 O'Brien et al.
6,886,354 B2 * 5/2005 Dudley ..... F04B 39/0207 417/13
7,284,391 B2 * 10/2007 Miller ..... F25B 5/02 417/423.14
7,290,990 B2 * 11/2007 Lifson ..... F04C 18/0215 417/325
7,984,684 B2 * 7/2011 Hinderks ..... B63B 1/28 114/274
2002/0170780 A1 * 11/2002 O'Brien ..... F04B 49/065 184/6.22
2007/0000261 A1 * 1/2007 Flynn ..... C09K 5/045 62/114
2010/0011788 A1 * 1/2010 Lifson ..... F25B 31/002 62/115
2010/0254834 A1 * 10/2010 Tolbert, Jr. ..... F04B 53/08 417/410.1
2010/0278660 A1 * 11/2010 Burchill ..... F04B 49/02 417/53
2011/0070100 A1 * 3/2011 McSweeney ..... F04B 35/04 417/53
2012/0023984 A1 * 2/2012 Sakai ..... F04B 39/121 62/126
2013/0031933 A1 * 2/2013 Manzo ..... F24D 19/1006 62/498
2014/0000295 A1 * 1/2014 Schuster ..... F25B 49/022 62/56
2014/0138451 A1 * 5/2014 Pham ..... F04B 35/04 237/12
2014/0230476 A1 * 8/2014 Yura ..... F25B 31/002 62/192
2014/0308138 A1 * 10/2014 Pham ..... F04C 28/06 417/12
2015/0075205 A1 * 3/2015 Ramayya ..... F04B 39/02 62/324.6
2015/0330690 A1 * 11/2015 Goel ..... G05B 15/02 62/175

FOREIGN PATENT DOCUMENTS

JP 10062028 A 3/1998
JP 2002277070 A 9/2002
JP 2008286419 A 11/2008
KR 20020009837 A 2/2002

* cited by examiner

METHOD OF OPERATING AN AIR CONDITIONING SYSTEM INCLUDING REDUCING THE ENERGY CONSUMED BY THE COMPRESSOR CRANK CASE HEATERS

BACKGROUND OF THE INVENTION

The subject matter disclosed herein relates to climate control systems. More specifically, the subject disclosure relates to crank case heater operation for packaged air conditioning units.

Compressors are utilized in heating, cooling and refrigeration applications. These compressors require oil or other lubricant to lubricate moving parts of the compressor. The oil is housed in a crank case from where it is drawn into moving parts of the compressor. During normal operation of the refrigeration circuit, operating pressures and temperatures tend to keep the oil free from liquid refrigerant. When the compressor is not operating, however, refrigerant in the system tends to migrate to and condense in the coldest parts of the system, one of which is often the compressor crank case. Under such conditions, there is a danger that the crank case oil will be diluted with refrigerant reducing its viscosity to the point where if the compressor is then restarted, damage may occur. Crank case heaters are utilized to boil off the refrigerant from the crank case and to prevent migration of the refrigerant thereto.

Many packaged air conditioning units, such as those servicing large buildings or spaces, include multiple interlinked air conditioning circuits. Each circuit may include at least one compressor, at least one condenser, at least one evaporator, and at least one expansion valve. Each compressor in the air conditioning unit has a crank case heater connected to it to boil off liquid refrigerant when the compressor is in "off" mode.

In some environments, the compressors operate mostly on a seasonal basis, during which the compressors may sit idle for extended time periods, for example 3 to 6 months at a time. In current systems, the crank case heater for each compressor is then in operation for the entire time the compressors are idle to boil off the liquid refrigerant. This results in substantial energy usage by the crank case heaters.

BRIEF DESCRIPTION OF THE INVENTION

According to one aspect of the invention, a method of operating an air conditioning system includes cooling a selected space with the air conditioning system. The air conditioning system includes two or more compressors and two or more crank case heaters. Each crank case heater of the two or more crank case heaters is associated with a compressor of the two or more compressors. Operation of the two or more compressors is stopped, thus initiating operation of the two or more crank case heaters. The air conditioning system is switched to a conservation mode, including de-powering at least one compressor of the two or more compressors and an associated at least one crank case heater or the two or more crank case heaters thereby reducing energy consumption of the two or more crank case heaters.

According to another aspect of the invention, an air conditioning system includes two or more compressors and two or more crank case heaters. Each crank case heater is associated with a compressor of the two or more compressors to prevent condensation of refrigerant in a compressor lubricant crank case. At least one crank case heater of the two or more crank case heaters and at least one compressor of the two or more compressors are de-powered upon the air conditioning system entering a conservation mode to reduce energy consumption by the two or more crank case heaters.

The detailed description explains the invention, together with advantages and features, by way of examples with reference to the drawings.

DETAILED DESCRIPTION OF THE INVENTION

Figure 1:
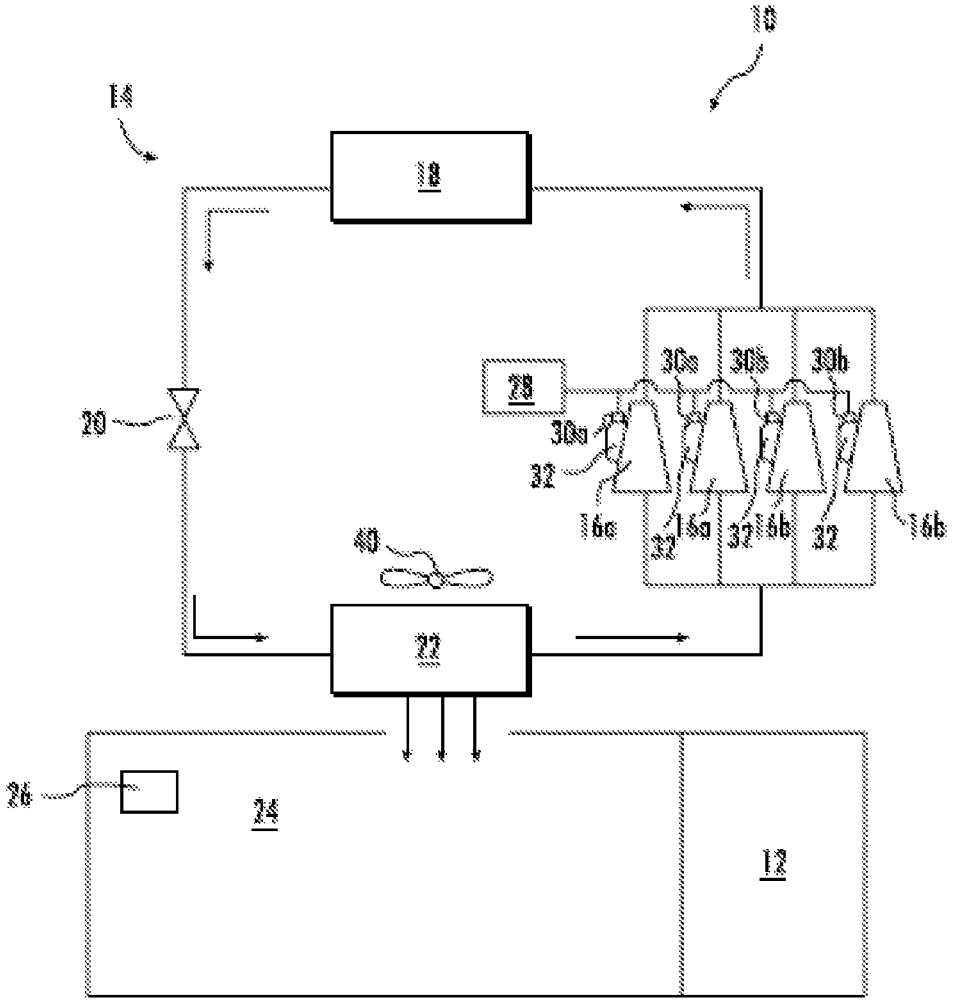
FIG. 1 is a schematic illustration of an embodiment of an air conditioning system.
Figure 2:
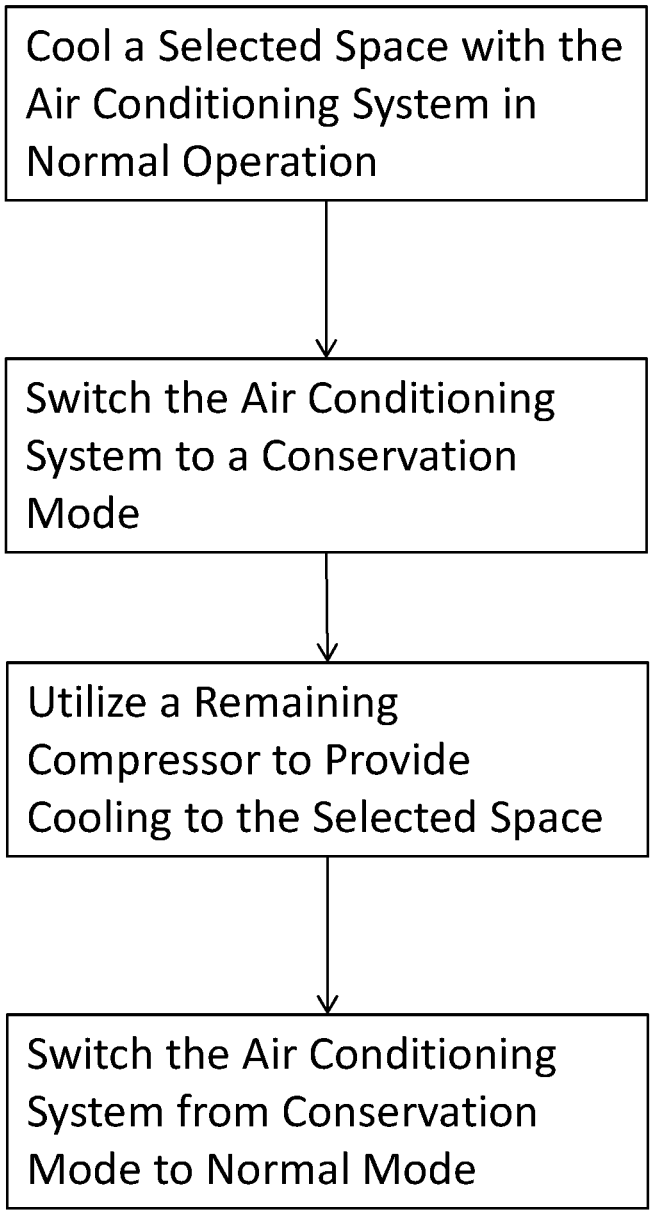
FIG. 2 is a schematic illustration of a method of operating an air conditioning system.

Shown in FIG. 1 and FIG. 2 are schematic illustrations of an embodiment of a packaged air conditioning system 10 servicing a designated portion 24 of a building 12, or other space. The air conditioning system 10 includes one or more air conditioning circuits 14, each air conditioning circuit 14 including multiple compressors 16, for example, four compressors 16 arranged in parallel, at least one condenser 18, at least one expansion valve 20 and at least one evaporator 22. While the embodiment of FIG. 1 includes four compressors 16 in the air conditioning circuit 14, it is to be appreciated that air conditioning systems 10 may include other quantities of compressors 16, for example, 2, 8 or more compressors 16. Each air conditioning circuit 14 may be assigned to cool the designated portion 24 of the building 10, with operation of the air conditioning circuit 14 triggered by a thermostat 26 disposed in the designated portion 24 and operably connected to a control unit 28 of the air conditioning circuit 14.

During normal operation of the air conditioning system 10, when a temperature at the thermostat 26 in the designated portion 24 exceeds a threshold temperature or set point, the thermostat 26 signals the control unit 28, which begins operation of the air conditioning circuit 14 by starting operation of the compressors 16. Refrigerant flows through the circuit 14, through the compressors 16, condenser 18, expansion valve 20 and evaporator 22. A fan 40 blows air across the evaporator 22, cooling the air, which is flowed into the designated portion 24. When air temperature at the thermostat 26 is lowered to or under the set point, within a designated tolerance, the thermostat 26 signals the control unit 28 again, which stops operation of the compressors 16. During typical operation of the air conditioning system 10, once the compressors 16 are stopped by the control unit 28, the control unit 28 subsequently starts operation of crank case heaters 30 disposed at a crank case 32 of each compressor 16. The crank case 32 houses lubricant for the compressor 16, and when the compressor 16 is turned off, refrigerant tends to migrate to and condense in the crank case 32. The crank case heater 30 for each compressor 16 is used to boil off any liquid refrigerant in the crank case 32 and prevent additional refrigerant from condensing therein.

When installed in some environments, the compressors 16 may not operate for extended periods of time. For example, during a local winter season, the compressors 16 may not operate for 3 to 6 months. To conserve energy during these extended times of inactivity, the air conditioning system 10 is switched into a conservation mode, or winter mode. In winter mode, one or more of the compressors 16*a* and associated crank case heaters 30*a* are taken off line by the controller 28. For example, in circuits 14 including four compressors 16, two or three compressors 16*a* and crank case heaters 30*a* are taken off line and are not operational when the controller 28 has selected winter mode for operation. When there are needs for compressor 16 operation and cooling during such winter mode periods, it will typically be a low-load need, so the remaining operational compressor 16*b* or compressors 16*b* may be started in order to provide this periodic cooling. When the system 10 is switched from winter mode to normal mode, the offline compressors 16*a* and associated crank case heaters 30*a* are powered, and before starting operation of the compressors 16*a*, the crank case heaters 30*a* are operated for a selected time, for example, 24 hours, prior to starting operation of the compressors 16*a*.

Switching of the system 10 to and from winter mode at the controller 28 may be accomplished by any of several means. In some embodiments, the switch to and from winter mode is determined by a calendar date range programmed into the controller 28. In other embodiments, the switch may be determined by an algorithm using trends in exterior air temperature and/or other factors. Finally, in other embodiments, the system 10 may be switched to or from winter mode manually by an operator at the controller 28.

In winter mode, only the crank case heaters 30*b* corresponding to the operational compressors 16*b* are powered. Thus a significant energy savings may be realized.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method of operating an air conditioning system comprising:

cooling a selected space with the air conditioning system including:

two or more compressors; and two or more crank case heaters, each crank case heater of the two or more crank case heaters operably connected to a compressor of the two or more compressors;

stopping operation of the two or more compressors, thus initiating operation of the two or more crank case heaters; and switching the air conditioning system to a conservation mode, including removing from operation at least one compressor of the two or more compressors and at least one crank case heater of the two or more crank case heaters thereby reducing energy consumption of the two or more crank case heaters; and utilizing a remaining compressor of the two or more compressors to provide cooling to the selected space when the air conditioning system is operated in conservation mode.

2. The method of claim 1, wherein the remaining compressors comprise two or fewer compressors.

3. The method of claim 1, wherein the two or more compressors comprise four or more compressors.

4. The method of claim 1, further comprising switching the air conditioning system from the conservation mode to a normal mode wherein all of the crank case heaters of the two or more crank case heaters are powered.

5. The method of claim 4, further comprising starting operation of the two or more compressors.

6. A method of operating an air conditioning system comprising:

cooling a selected space with the air conditioning system including:

two or more compressors; and two or more crank case heaters, each crank case heater of the two or more crank case heaters operably connected to a compressor of the two or more compressors;

stopping operation of the two or more compressors, thus initiating operation of the two or more crank case heaters; and switching the air conditioning system to a conservation mode, including removing from operation at least one compressor of the two or more compressors and at least one crank case heater of the two or more crank case heaters thereby reducing energy consumption of the two or more crank case heaters;

wherein switching the air conditioning system into the conservation modes further comprises:

programming a calendar date range into a controller for the air conditioning system; and switching the air conditioning system to the conservation mode upon the occurrence of the first calendar date in the calendar date range via the controller.

* * * * *